US008770396B2

(12) United States Patent
Salys

(10) Patent No.: US 8,770,396 B2
(45) Date of Patent: Jul. 8, 2014

(54) STORAGE AND DRYING DEVICE FOR HELMETS AND ACCESSORIES (VISOR, GLOVES, SHOULDER PADS, NECK BRACE, KNEE PADS, KEYS, ETC.)

(76) Inventor: Eric K. Salys, Pflugerville, TX (US)

( * ) Notice: Subject to any disclaimer, the term of this patent is extended or adjusted under 35 U.S.C. 154(b) by 224 days.

(21) Appl. No.: 13/214,178

(22) Filed: Aug. 20, 2011

(65) Prior Publication Data

US 2012/0043229 A1 Feb. 23, 2012

Related U.S. Application Data

(60) Provisional application No. 61/375,255, filed on Aug. 20, 2010.

(51) Int. Cl.

| | |
|---|---|
| ***A42B 3/00*** | (2006.01) |
| ***A45C 11/02*** | (2006.01) |
| ***B65D 85/18*** | (2006.01) |

(52) U.S. Cl.

CPC ..... *A42B 3/006* (2013.01); *A45C 11/02* (2013.01); *B65D 85/18* (2013.01)

USPC ..... 206/8; 190/107; 383/33

(58) Field of Classification Search

USPC ..... 206/8, 378, 386, 278, 286; 2/422; 211/30; 190/107; 383/13, 16, 22, 32, 383/33; 224/901.2, 927, 933, 438

See application file for complete search history.

(56) References Cited

U.S. PATENT DOCUMENTS

| | | | | |
|---|---|---|---|---|
| 633,864 | A * | 9/1899 | Lindsey | 312/201 |
| 2,122,617 | A * | 7/1938 | McD Marshall | 223/92 |
| 2,526,385 | A * | 10/1950 | Meyer | 206/287 |
| 2,845,185 | A | 7/1958 | Winderweedle | |
| 3,128,812 | A * | 4/1964 | Scheurer | 206/315.4 |
| 3,669,276 | A | 6/1972 | Woods | |
| 3,929,224 | A * | 12/1975 | Smith, Jr. | 206/287 |
| 4,684,096 | A | 8/1987 | Tanaka | |
| 5,265,784 | A | 11/1993 | Gregory | |
| 5,377,849 | A | 1/1995 | Martin | |
| D355,085 | S | 2/1995 | Wilhite | |
| 5,480,023 | A * | 1/1996 | Puller | 206/8 |

(Continued)

FOREIGN PATENT DOCUMENTS

| | | | |
|---|---|---|---|
| JP | 2008121184 | A | 5/2008 |

*Primary Examiner* — Sue A Weaver

(57) ABSTRACT

The invention provides a new method for the safe storage and drying of a helmet and related accessories (spare helmet face shield, sunglasses, goggles, primary gloves, secondary gloves, chin curtain, breath deflector/guard, helmet screws, neck brace, knee pads, elbow pads, chest protector, keys, and remote control gate/garage openers) employed in activities in which a helmet is utilized. The device is suspended utilizing various length interchangeable hanging straps possessing varied attachment methods to accommodate various hanging locations. The side connected hanging straps attach at an angle to the front opening so that the front opening is directed at an upward facing angle off of the vertical plane and a center angle adjustment and interlocking strap is utilized to set a preferred angle and interlink multiple devices hung vertically one under another. The angled orientation enables the device to be bumped or swung without concern that the helmet or other items stored therein will fall out. The shape and flexible nature of the device allows the sides to close in toward the helmet under the weight of a resting helmet. The device employs multiple attachment points and pockets to accommodate the related accessories and their related locations are such that they provide for the easy access to storage and removal based on frequency of use and order in which stored and removed.

24 Claims, 14 Drawing Sheets

(56) References Cited

U.S. PATENT DOCUMENTS

| | | | | |
|---|---|---|---|---|
| D367,179 | S | 2/1996 | Denissen | |
| 5,528,840 | A | 6/1996 | Pajak | |
| 5,628,398 | A * | 5/1997 | Jackson | 206/287.1 |
| 5,921,403 | A * | 7/1999 | Coffaro | 211/32 |
| 5,927,515 | A | 7/1999 | Llaurado Morant | |
| 6,073,783 | A | 6/2000 | Allman | |
| D429,091 | S | 8/2000 | Chen | |
| 6,102,569 | A * | 8/2000 | Wang | 383/104 |
| 6,176,408 | B1 | 1/2001 | Miner | |
| 6,216,887 | B1 | 4/2001 | Soo | |
| 6,263,591 | B1 | 7/2001 | La Porte | |
| 6,390,573 | B1 | 5/2002 | Wang | |
| 6,508,587 | B1 * | 1/2003 | Byers, Jr. | 383/33 |
| 6,553,687 | B1 | 4/2003 | Leamon, Jr. | |
| 6,711,752 | B2 | 3/2004 | Smith | |
| 6,719,157 | B2 | 4/2004 | Stoddart | |
| 6,880,711 | B2 | 4/2005 | Collier | |
| 6,948,599 | B2 | 9/2005 | Rodrigue | |
| 7,063,397 | B2 | 6/2006 | Sabounjian | |
| D539,580 | S | 4/2007 | Greiner | |
| D540,583 | S | 4/2007 | Greiner | |
| D547,579 | S | 7/2007 | Greiner | |
| D551,472 | S | 9/2007 | Greiner | |
| D551,473 | S | 9/2007 | Greiner | |
| 7,328,780 | B2 | 2/2008 | Hawthorne | |
| D566,986 | S | 4/2008 | Greiner | |
| 7,604,102 | B2 | 10/2009 | Albritton | |
| 7,681,728 | B2 | 3/2010 | Sabounjian | |
| 7,752,683 | B2 | 7/2010 | Holloway | |
| 7,789,250 | B2 | 9/2010 | Aamodt | |
| 7,841,467 | B2 * | 11/2010 | Slayton | 206/315.1 |
| 7,950,532 | B2 | 5/2011 | Ziaylek | |
| 2003/0188448 | A1 | 10/2003 | Reed | |
| 2005/0127056 | A1 * | 6/2005 | Petkov et al. | 219/211 |
| 2005/0160617 | A1 | 7/2005 | Fouts, II | |
| 2006/0157522 | A1 * | 7/2006 | Cheng | 224/413 |
| 2007/0102383 | A1 | 5/2007 | Evans | |
| 2008/0134538 | A1 | 6/2008 | McFarland | |
| 2009/0283485 | A1 | 11/2009 | Anderson | |

* cited by examiner

STORAGE AND DRYING DEVICE FOR HELMETS AND ACCESSORIES (VISOR, GLOVES, SHOULDER PADS, NECK BRACE, KNEE PADS, KEYS, ETC.)

CROSS REFERENCE TO RELATED APPLICATIONS

This application relates to and claims priority from U.S. Provisional Application No. 61/375,255 filed on Aug. 20, 2010, which is herein incorporated by reference.

FIELD OF THE INVENTION

The invention pertains to storage of safety gear, and particularly to storage of motorized sports or athletic helmets, gloves, keys, glasses, and the like.

BACKGROUND OF THE INVENTION

The use of protective equipment and accessories utilized by riders of motorcycles, snowmobiles, motorized three-wheelers/four-wheelers, or bicycles has increased over the years as laws and public awareness have focused more on rider safety. With the increase in the use of protective equipment and accessories, the number of products utilized and the technologies employed in those products have increased resulting in much higher prices and total investments in the products. Riders can often spend over $1,000 on protective equipment and accessories, including; helmet, primary face shield, secondary tinted face shield, helmet chin curtain, helmet breath deflector/guard, warm weather riding gloves, cold weather riding gloves, glasses, goggles, neck brace, knee pads, elbow pads, chest protector, and riding safety jacket. This increase in number and types of equipment and accessories presents certain storage challenges, particularly for the varying frequency of use of the various pieces of equipment for different weather or other riding conditions.

Existing storage solutions have generally been designed for single pieces of equipment. For example, a protective helmet backpack disclosed in U.S. Pat. No. 6,176,408 and helmet sack disclosed in U.S. Pat. No. 5,265,784 accommodate a single helmet in transit. Such storage solutions are generally closed systems that may not suitably facilitate the drying of helmets, gloves, or other pieces of equipment.

Accordingly, improvements are sought in storing diverse rider equipment in a convenient form factor.

BRIEF SUMMARY OF THE INVENTION

The present invention provides comprehensive storage for rider equipment and related accessories so that items are not misplaced or lost. The storage device provides protective compartments and coverings for equipment (helmet, spare helmet face shield, sunglasses, goggles, primary gloves, secondary gloves, chin curtain, breath deflector/guard, helmet screws, neck brace, knee pads, elbow pads, chest protector, keys, and remote control gate/garage openers) typically utilized by a rider of motorcycles, snowmobiles, or motorized three-wheelers/four-wheelers. The device further provides for drying of equipment such as gloves. Thus, various rider equipment may be kept in one location and stored in a manner that protects the equipment from potential loss or damage while still allowing it to dry quickly after use.

Some of the advantages of embodiments of the present invention include:

1) Drying—After use, primarily during the warmer months of the year, the helmet, gloves, and other equipment are often wet with perspiration or weather related moisture. To facilitate drying and to reduce equipment odor, the device allows them to be stored in a manner that exposes them to ambient air rather than sealing them in a closed system.
2) Protection—The helmet, face shield, and secondary face shield are received in soft and secure compartments to preserve against scratching and chipping that may compromise their safety or obstruct the rider's view when used. Further, the device prevents against damage from inadvertent bumps and falls.
3) Access—While putting on and removing the equipment, before and after a ride, the device design facilitates easy access to the items in an order in which the equipment is generally put on and taken off.
4) Consolidated Location—Part of the equipment is accessed only occasionally or is designed for either warm or cold seasons creating separate and unrelated storage locations for the off-season equipment. As such, the storage device includes out-of-the-way storage locations for off season and occasional use items.
5) Interlocking Devices—Riders often have a second set of equipment, e.g., for passengers. To accommodate multiple sets of equipment, the device includes features to enable the vertical storage/interlocking of multiple devices.

Some embodiments feature dedicated storage and/or retainers for individual equipment items. This may be desirable, for example, to have a single key retained on the storage device to obviate the need for inclusion of the key on a larger key ring and the associated risk of abrasion to motorcycle tank finishes.

The present invention presents a novel, useful, and practical means for the storage, drying, protection and display of equipment (helmet, spare helmet face shield, sunglasses, goggles, primary gloves, secondary gloves, chin curtain, breath deflector/guard, helmet screws, tools, neck brace, knee pads, elbow pads, chest protector, keys, and remote control gate/garage openers) typically utilized by a rider of motorcycles, snowmobiles, motorized three-wheelers/four-wheelers or bicycles. Specific embodiments of the present invention may be adapted to store military equipment, motocross, snowmobiling and sports equipment.

The device, as a unit, is designed to be suspended rather than taking up floor or shelf space with rider equipment. For example, detachable and interchangeable hanging straps of various lengths and designs facilitate the ability to hang the device from ceilings, coat hangers, closet coat hanger bars, backs of closet doors, under cabinets or shelves, inside transportation trailers, lockers, and the like. The side mounted hanging straps are attached to the device at an angle so that the front opening is directed at an upward facing angle off of the vertical plane that is perpendicular to the floor. The angled orientation enables the device to be bumped or swung at angles up to 40° without concern that the helmet or other items stored therein will fall out. A third adjustable strap attached at the center-top of the device enables the user to set a preferred angle and generally limits the swing angle range of the device to about 40°. Multiple devices can be hung vertically one under another to provide additional space for more than one set of equipment. In this stacked arrangement, the side straps on the lower unit can attach to the ceiling, closet coat hanger bars, etc., or to the unit above it. The third center-top adjustable strap can be attached to a portion of the device above it. The vertical linking of multiple devices can further reduce the ability of any one device to swing at angles beyond 40°.

In order to store all the equipment appropriately a number of pockets, pouches, elastic drawstring, buttons with buttonholes, hook-and-eye assemblies, hook-and-loop fasteners, such as VELCRO™ brand touch fastener strips, snaps or other suitable fasteners or materials may be utilized in the device. The relative placement of each item's storage location on the device is situated based on frequency of use and order in which equipment is put on and taken off. The helmet, primary gloves, sunglasses, and key storage locations are all unobstructed and easily stored and used. Spare face shield, chin curtain, breath deflector/guard, helmet screws, tools, and secondary (offseason) gloves that are used and accessed less frequently may be stored in out of the way locations so as not to interfere with more frequently used items. Neck brace, knee pads, elbow pads, chest protector, can all hang underneath it.

Optionally, the device of the present invention may further provide separate storage compartments or mounting mechanisms, which increase the usefulness of the device by providing additional storage locations. Certain designs of these separate storage compartments and mounting mechanisms are compressible and expandable, and/or detachable and attachable in some embodiments. The ability to detach and attach separate storage compartments and mounting mechanisms allows the user to configure the device so that differences in helmet design and equipment may be accommodated.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION OF THE INVENTION

Figure 9:
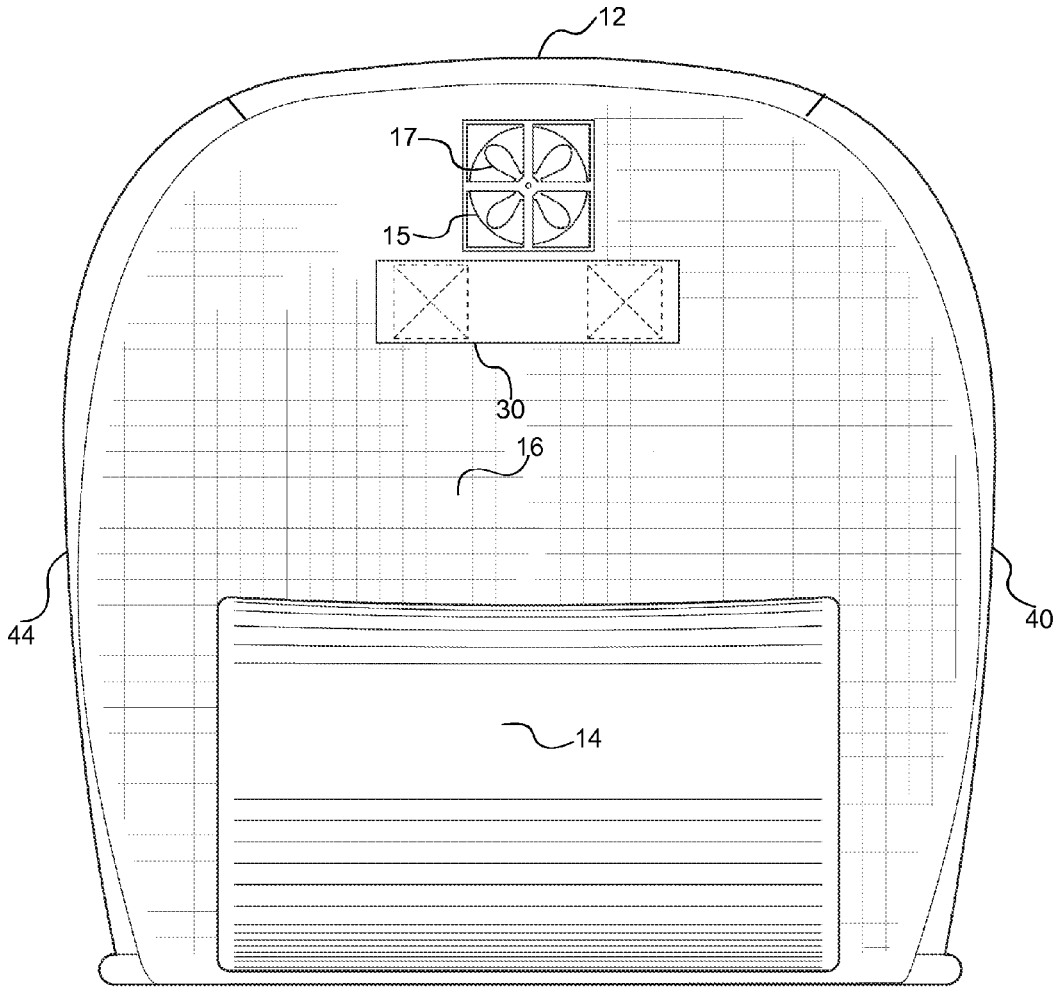
FIG. 9 is an angled bottom view of one embodiment.

The main compartment of the device is designed to accommodate a helmet and includes three sides (left sidewall portion 40 (FIGS. 1, 5, 8, & 9), right sidewall portion 44 (FIGS. 1, 6, 8, 9, & 12), and rear portion 12 (FIGS. 2, 3, 4, 7, 8, & 9)), a bottom portion 16 (FIGS. 1, 2, 3, 4, 9, & 12), and an arched top portion 22 (FIGS. 1, 3, 4, 5, 8, & 12). Access to the helmet enclosure is gained through an open, flexible and semi-rigid front opening 10 (FIGS. 1, 2, 3, 4, 5, 7, 8, & 12). The rear portion 12 of the helmet enclosure is held up by a flexible and semi-rigid rear support structure 38 (FIGS. 1, 5, 8, & 12). In some embodiments, the bottom portion 16 of the helmet enclosure is flat and semi-rigid and contours to the head opening on the bottom of a full face helmet and in other embodiments, it is shaped to receive the head opening of a ¾ helmet, or the top or side of a helmet. In this manner the bottom may be adapted to accommodate a wide range of helmet types. The semi-rigid bottom portion 16 of the helmet enclosure forms a surface to set the helmet on (FIG. 10) while also enabling the folding/collapsing of the bottom portion 16 along the bottom fold line 56 (FIG. 11) when a smaller size is desired during inventorying and shipping of the device. The flexibility of the bottom portion 16 enables the folding of the bottom portion 16 so that it doesn't interfere with the flexible front opening 10 and rear support 38 structures. The helmet enclosure's flexible, front opening 10, rear support 38, and helmet contoured bottom portion 16 provide structure while allowing the enclosure to tighten around the hard sides and back of the helmet when the weight of the helmet is placed in the enclosure. The tension around the helmet is then released as the helmet is lifted out. This tightening feature further limits the likelihood of the helmet falling out of the enclosure when bumped or swung. The helmet enclosure's always open front opening 10 allows the face shield (for helmets with face shields) to be tilted up/open for quick and thorough drying of sweat or moisture contained in the helmet. To further speed up the drying process, a passage or aperture 15 (FIG. 9) may be provided in the bottom portion 16 of the helmet enclosure and optionally a small fan 17 (FIG. 9) can then be mounted to blow air through the passage and onto the helmet's interior contained in the helmet enclosure.

The device is designed to be hung, or suspended from; ceilings, coat hangers, closet coat hanger bars, backs of closet doors, under cabinets or shelves, inside transportation trailers, and the like. On the left and right sidewall portions 40 & 44 of the device are attached side anchor mounts 8 (FIGS. 1, 2, 3, 4, 5, 7, & 8) that are attached at an angle in relation to the bottom portion 16. The angle at which they are attached causes the front opening 10 to face slightly upward at an angle off of the vertical and aids in keeping the helmet contained in the device when the device is bumped or swung. Anchor mounts 8 provide one form of anchor mount means. In addition to the side anchor mounts 8 creating a hanging angle, the angle adjustment and interlocking strap 2 (FIGS. 1, 2, 3, 4, 5, 7, 8, 12, & 13) allows the user to further fine tune the angle at which the device hangs and prevents the angle from changing as items are placed into and removed from the device. One end of the angle adjustment and interlocking strap 2 can be permanently fixed to the front inside of the top portion 22 and the other end of the strap attaches to the angle adjustment fastener 42 (FIGS. 1, 5, 8, & 12) located on the exterior top portion 22. The angle adjustment fastener 42 may be hook and loop or an equivalent fastener. The angle adjustment and interlocking strap 2 may be used in two ways. First, when hanging multiple devices above/below one another, it may be fed from the top of the lower hanging device through the interlocking fastener 30 (FIGS. 5 & 9) located on the bottom portion 16 of the higher located device. This is demonstrated in FIG. 13. Or, when a device is being hung alone, from something such as a closet coat hanger bar, the angle adjustment and interlocking strap 2 can be fed around the bar and attached to the angle adjustment fastener 42.

Figure 1:
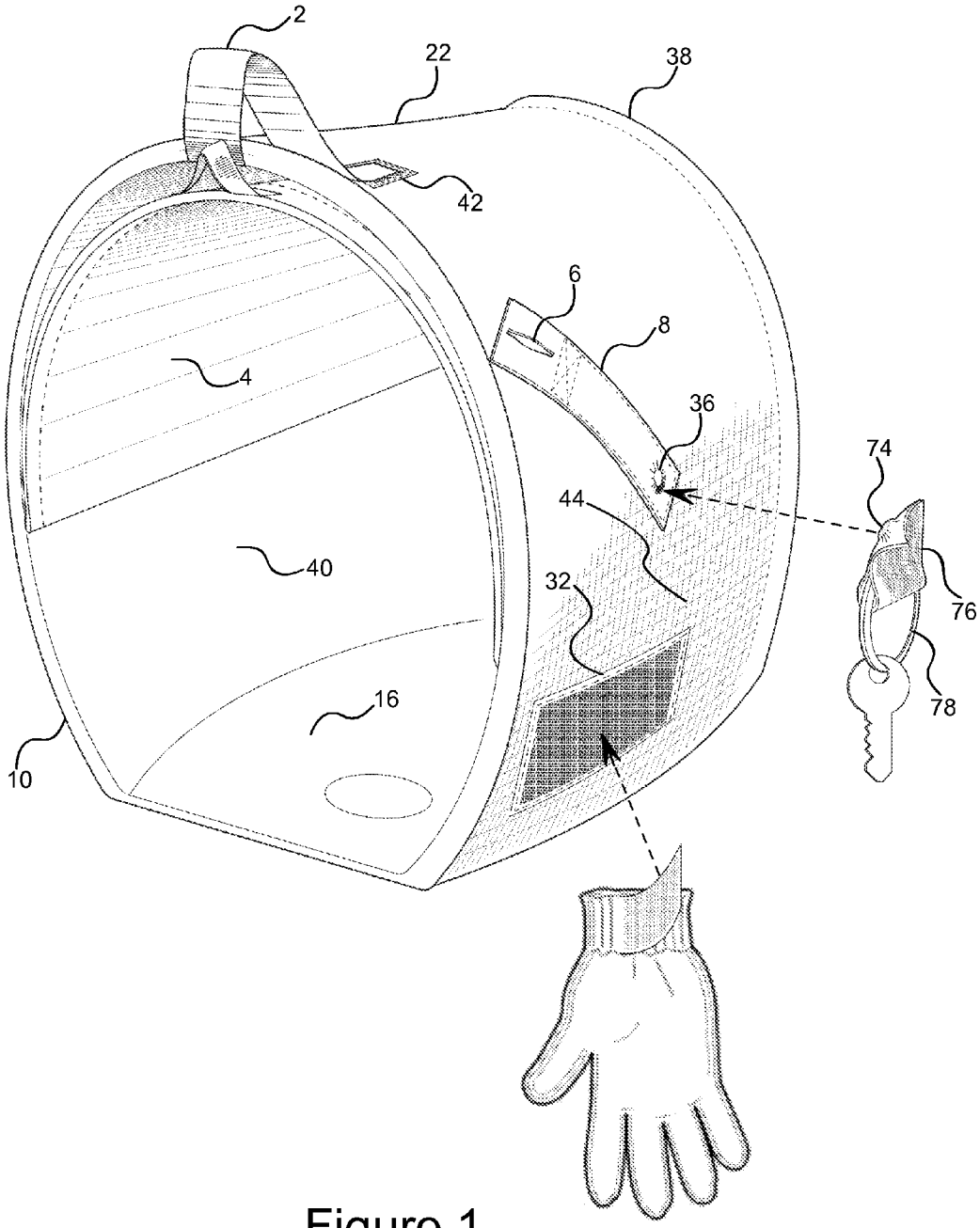
FIG. 1 is an angled perspective view of a front opening and right side of one embodiment.
Figure 2:
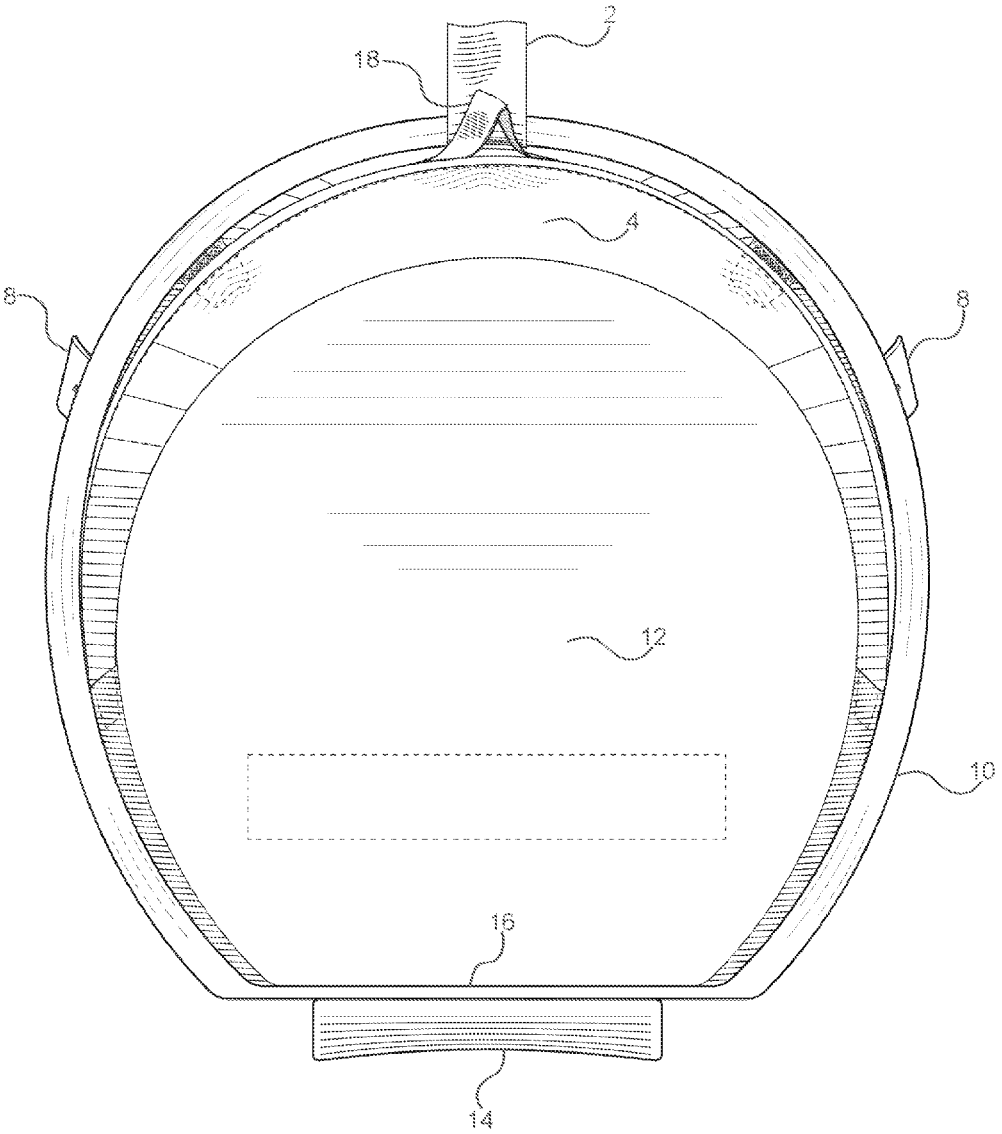
FIG. 2 is an angled front view of the embodiment of FIG. 1.
Figure 3:
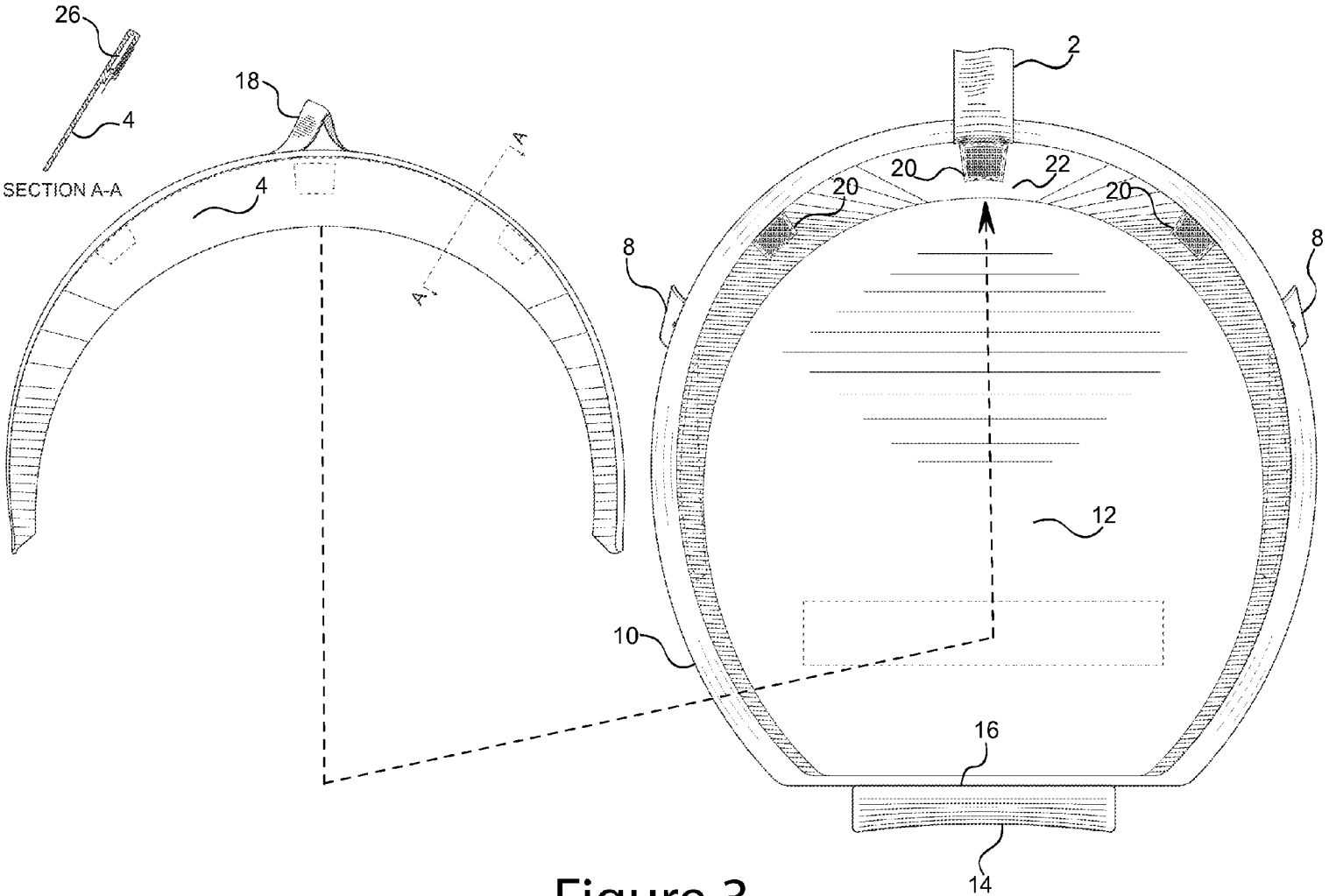
FIG. 3 is a disassembled view of the angled front view showing a visor pocket separate from the embodiment of FIG. 1.
Figure 4:
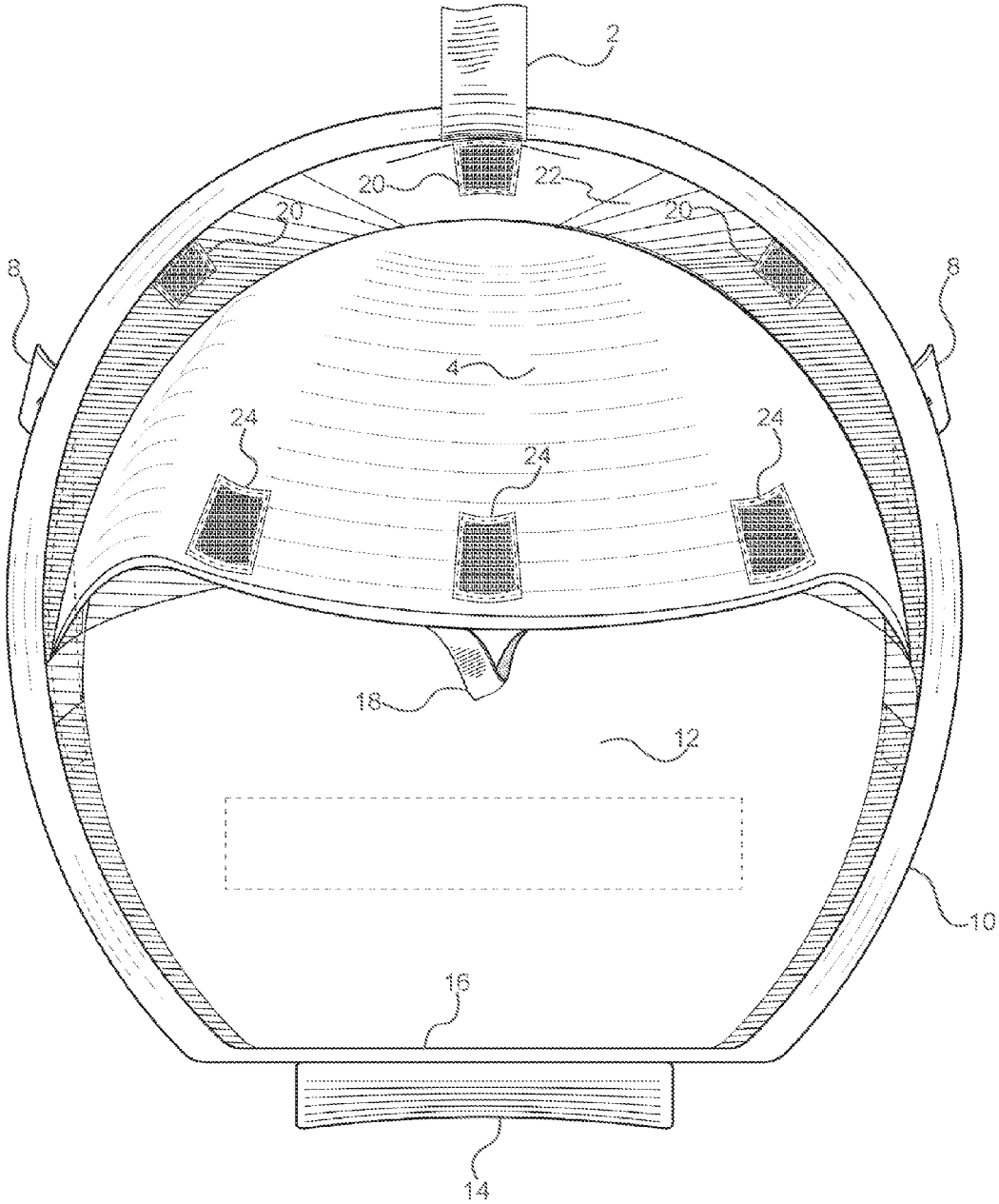
FIG. 4 is an angled front view of the embodiment of FIG. 1 with the visor pocket bottom in the biased open position.
Figure 5:
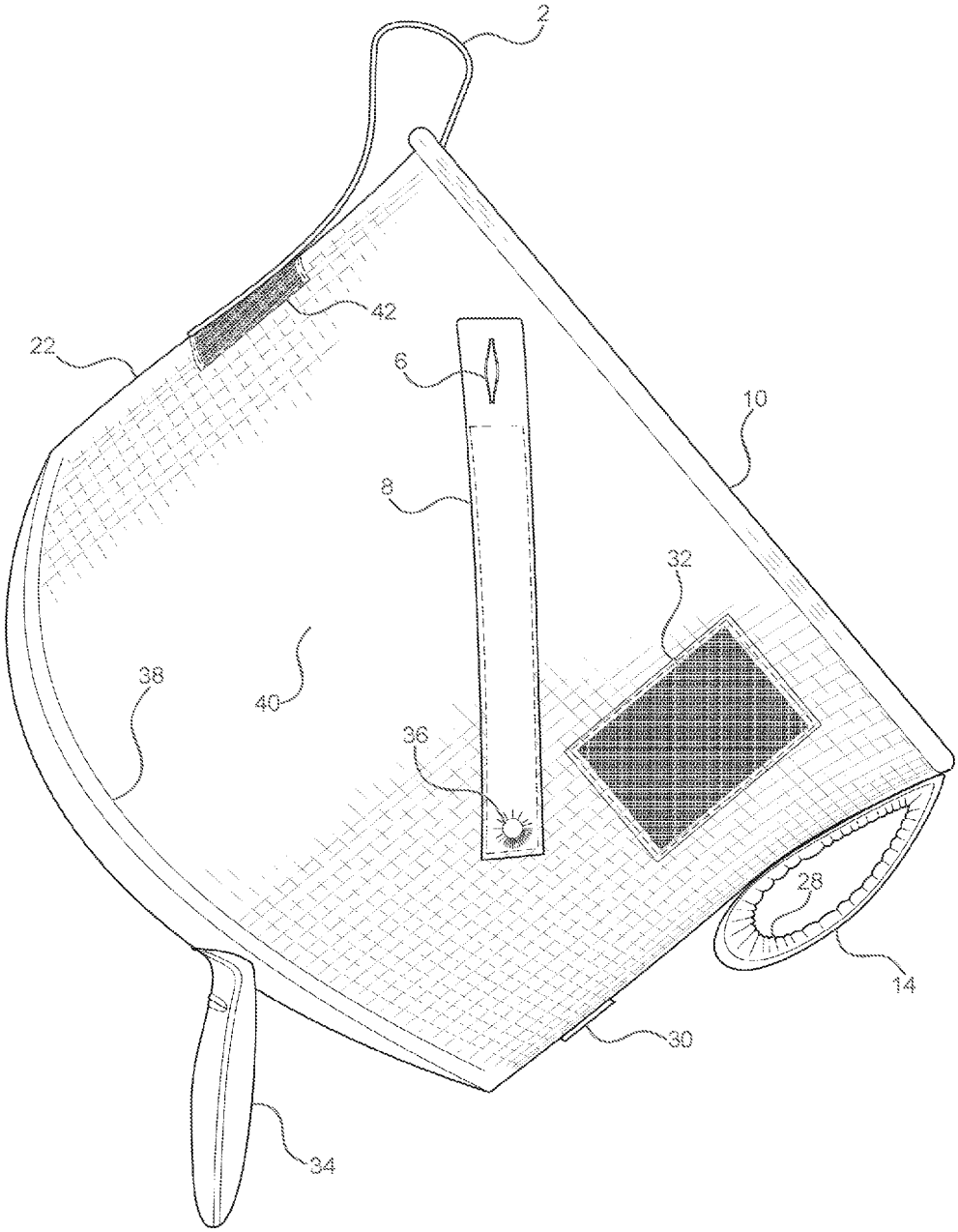
FIG. 5 is a left side view of the embodiment of FIG. 1.
Figure 6:
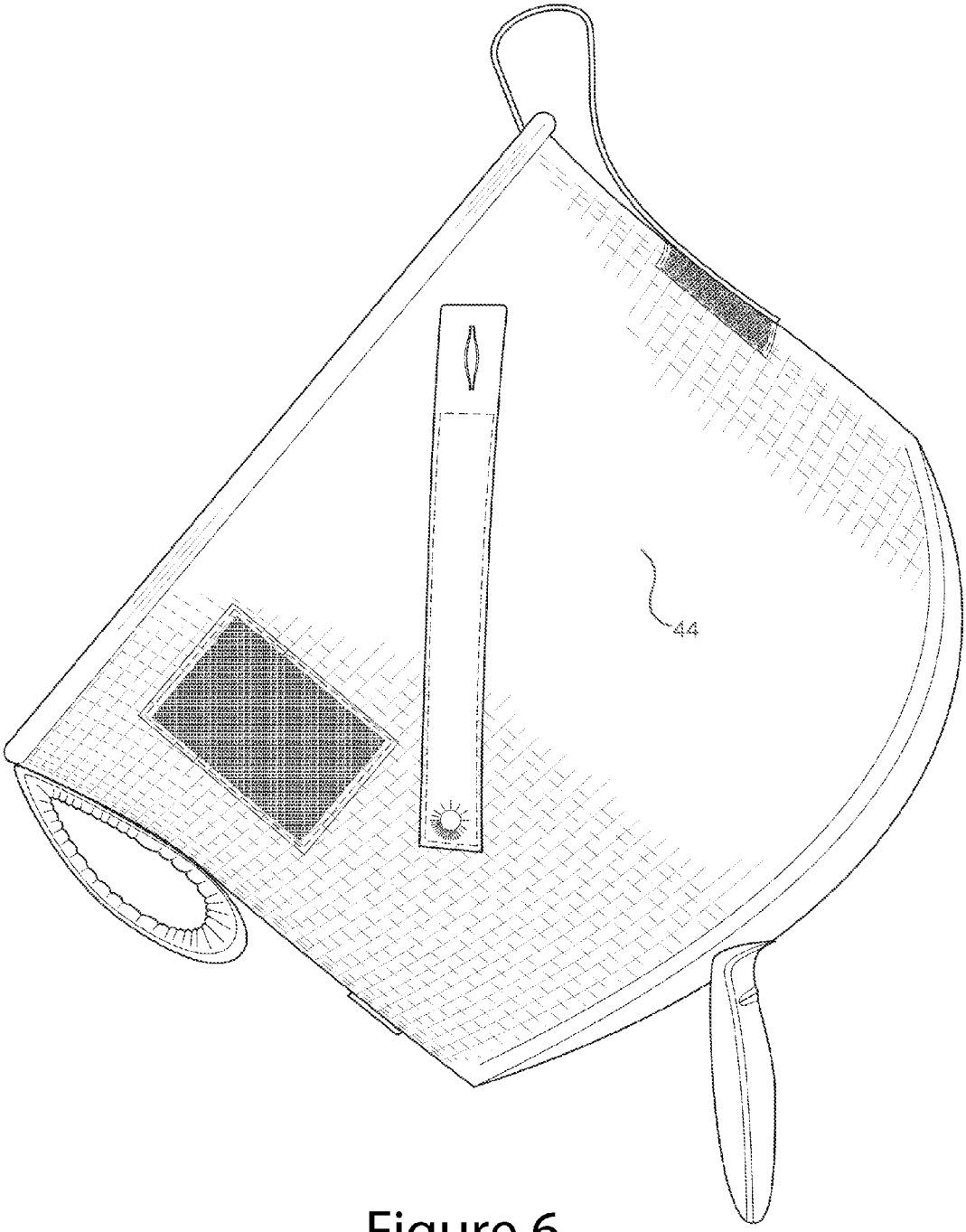
FIG. 6 is a right side view of the embodiment of FIG. 1.
Figure 10:
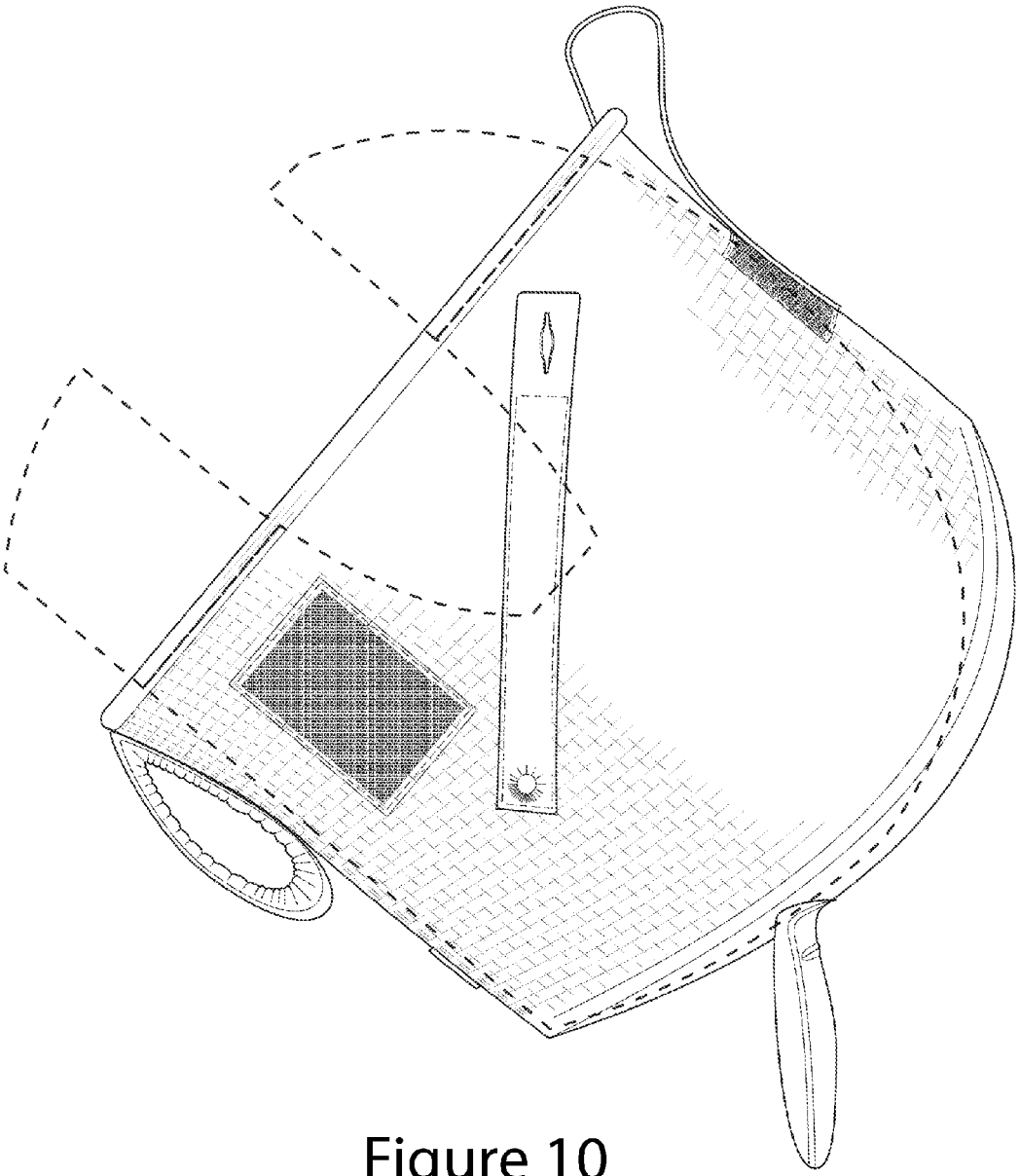
FIG. 10 is a right side view of the embodiment of FIG. 1 receiving a protective helmet (dashed lines)
Figure 11:
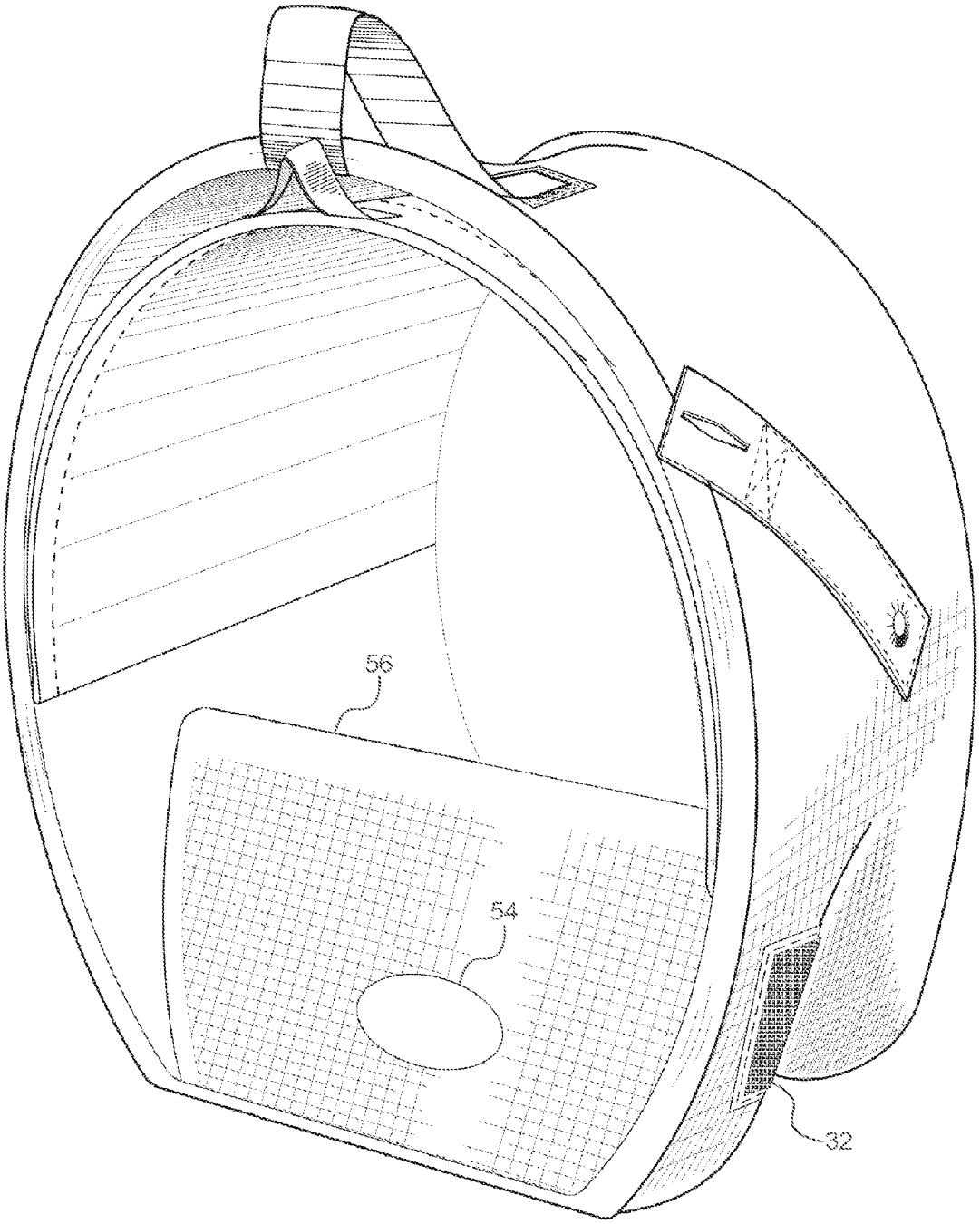
FIG. 11 is perspective view showing one embodiment being collapsed for shipping or inventorying.
Figure 13:
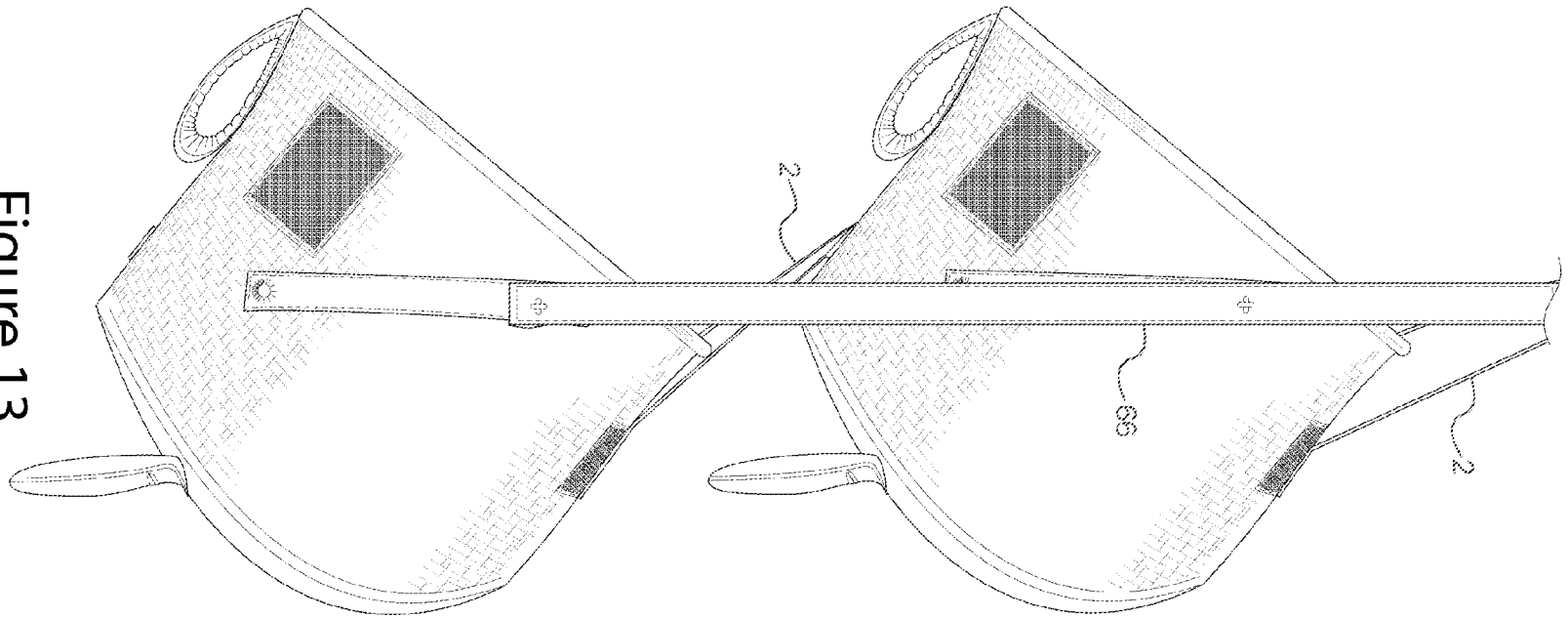
FIG. 13 is a right side view of two storage devices hanging linked together.
Figure 14:
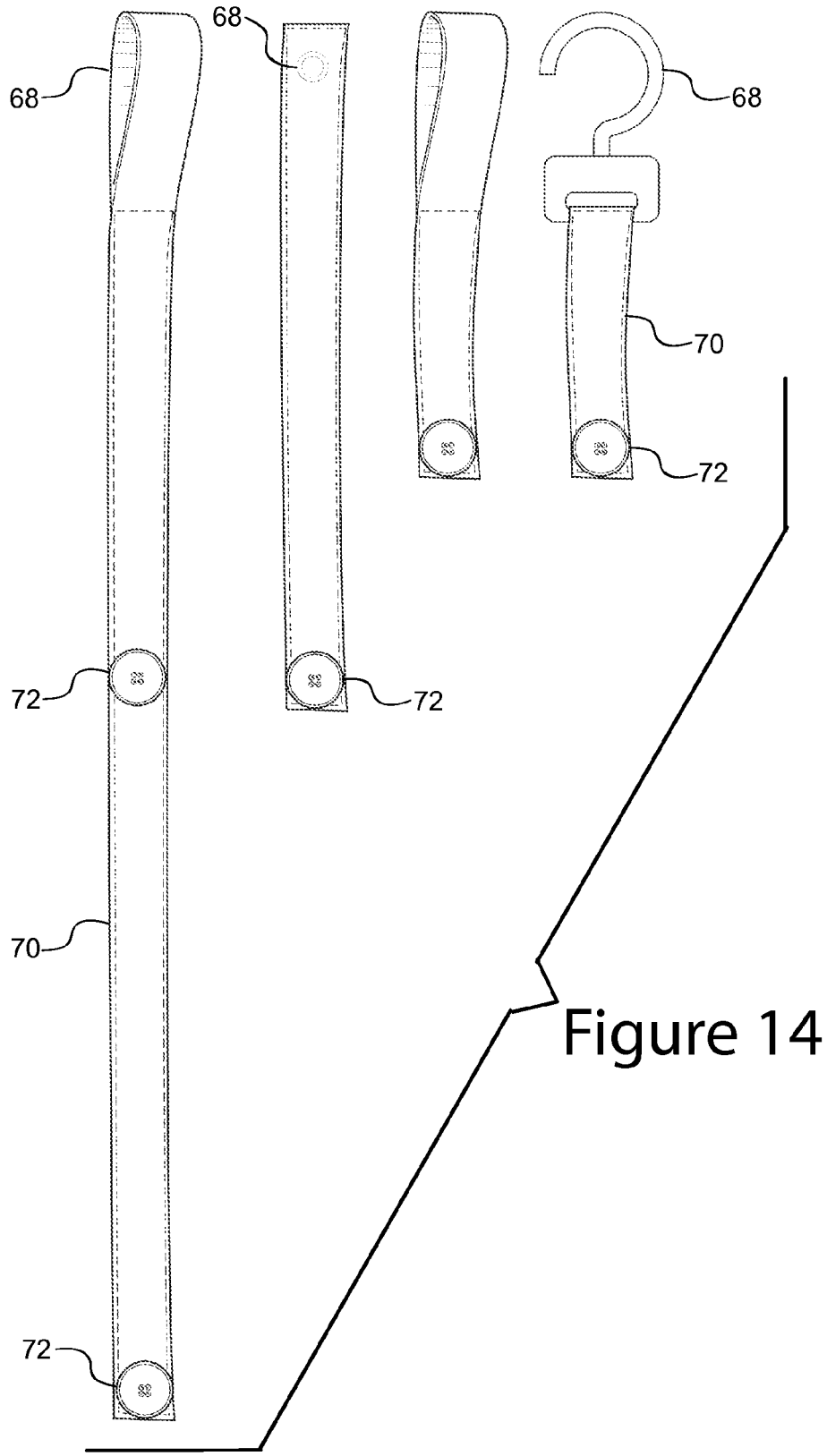
FIG. 14 illustrates several anchor embodiments.

As seen in FIGS. 5, 6, & 10 the side anchor mount 8 is oriented in the vertical plane to distribute forces evenly over its attachment to the device. Near the top end of the side anchor mount 8 is an anchor button hole 6 (FIGS. 1, 5, 7, 8, & 12). The anchor button hole 6 is intended to accommodate the anchor button 72 (FIG. 14) on the anchor assembly. The anchor assembly is generally composed of the anchor button 72, the anchor strap 70 (FIG. 14), and the anchor attachment 68 (FIG. 14). The type of anchor attachment 68 can vary from a loop to a hook, to an eyelet, and so on, with examples of some anchor assembly means illustrated in FIG. 14, in order to accommodate the mounting of the anchor assembly to ceilings, coat hangers, closet coat hanger bars, backs of closet doors, under cabinets or shelves, inside transportation trailers and the like. In mounting to these items, the length of the anchor strap 70 can vary to accommodate the appropriate hanging height of the device. In cases in which hanging multiple devices above/below one another is desired, a multi-device anchor assembly 66 (FIG. 13) may be used. The multi-device anchor assembly 66 contains multiple anchor buttons 72 spaced so that they can be received by the anchor button holes 6 of multiple devices without the devices interfering with each others hanging. The number of devices that can be hung above/below one another can be increased by increasing the length of the multi-device anchor assembly 66 and increasing the number of anchor buttons 72. Connecting the anchor mount 8 to an anchor assembly by means of the anchor button hole 6 and the anchor button 72 may be substituted by other equivalent fastening devices known in the art. In alternative embodiments to hanging multiple devices above/below one another, each device may be hung with its own separate anchor assembly of the appropriate length, or each device may be directly connected to the one above it, with only the top position device attaching to the anchor assembly.

Just inside the device's main helmet compartment is a narrow soft scratch resistant form-fitting interior pocket that follows the curved exterior contour of the top portion 22. The device's top portion 22 contour follows the curvature of the average helmet visor and the visor pocket bottom 4 (FIGS. 1, 2, 3, 4, & 12) follows said contour and is designed to safely hold a secondary visor/face shield for the helmet. The visor pocket bottom 4 is fastened in place along the rear portion 12, the left sidewall portions 40 and the right sidewall portion 44. The pocket is accessed from the front by pulling down the visor pocket tab 18 (FIGS. 2, 3, 4, & 12). Internal to the visor pocket bottom 4 is a flexible semi-rigid visor pocket bias 26 (FIGS. 3 & 12) that may be a piece of plastic, metal, or the like, that causes the visor pocket bottom 4 to spring open when pulled down or spring up when closed. When the pocket is opened, the visor remains securely in place in the pocket due to the hanging angle of the device as a whole and the depth of the pocket. The visor can easily be removed or placed in the pocket when the pocket is in the open position. Upon closing the pocket, visor pocket fasteners 20 & 24 (FIGS. 3 & 4) that are hook & loop, or equivalent, engage, ensuring the pocket only opens when intended.

In some embodiments, the exterior bottom portion 16 includes a soft scratch resistant semi-rigid form fitting glasses pocket 14 (FIGS. 2, 3, 4, 5, 7, & 9) intended to store glasses or goggles. The general location allows for unobstructed access to the pocket. In some embodiments, the glasses pocket 14 is at the front edge and its general left and right side perspective opening can take the form of a wide range of shapes such as that of an oval or a triangle with rounded corners in which the bottom portion 16 makes up one side of the triangle and the pocket material makes up the other two sides. A curved triangular shape can provide for a small form factor while flexing to accommodate the varying size and shapes of glasses. In a particular implementation, to create a smaller appearance when looking at the device, the smallest angle in the triangle can be formed at the device's front edge. In some embodiments, the left and right sides of the glasses pocket 14 are open and glasses are able to be slid in and out from the left or right side. In this particular implementation, the center (from left to right) of the interior of the glasses pocket 14 may contain a glasses nose bridge catch 28 (FIG. 5) that is narrower than the sides but stretches/expands to reach the same size as the left and right side openings. This enables all sizes and shapes of glasses to snuggly slide in while the narrow center point then contracts on the narrowest point in the glasses, the nose bridge. The narrow expanding and contracting center nose bridge catch 28 prevents glasses from falling out when the device is tilted or bumped. In other embodiments of the design a simple elastic band may be used, or the location of the glasses holder may be moved, or the access to the glasses pocket 14 may be changed. The size of the glasses pocket 14 may be expanded or the design modified to accommodate goggles for riders who prefer them to glasses.

On the exterior left and right sidewall portions 40 & 44 is a glove fastener 32 (FIGS. 1, 5, 11, & 12) for the hanging and open air drying of protective gloves. Various embodiments of the glove mounting/fastening mechanism may be utilized, including; hook-and-loop fasteners, magnets, snaps, clips, buttons with buttonholes, elastic cords, hook-and-eye assemblies, or other suitable mounting/fastening mechanisms. The relative location on the left and right sidewall portions 40 & 44 facilitates unobstructed access to the mounting/fastening location and the stiffness of the structure created by the helmet's presence just inside the device's sidewalls enables easy manipulation of the mounting/fastening mechanism.

On the exterior left and/or right sidewall portions 40 & 44 of the device's main helmet compartment is a key/remote mount 36 (FIGS. 1, 5, 7, & 12) for the hanging of a non-scratching key/remote (gate/garage door opener) retainer. The retainer is intended to hold a key or remote typically utilized by riders of motorcycles, snowmobiles, motorized three-wheelers/four-wheelers, or bicycles. The retainer is generally composed of three pieces; the key/remote clip 78 (FIG. 1), the retainer strap 76 (FIG. 1), and the retainer fastener 74 (FIG. 1) that mates with the key/remote mount 36. Various embodiments of the mounting/fastening mechanism may be utilized, including; hook-and-loop fasteners, magnets, snaps, clips, buttons with buttonholes, elastic cords, hook-and-eye assemblies, or other suitable mounting/fastening mechanisms. The relative location, on the left and right sidewall portions 40 & 44, facilitates unobstructed access to the key/remote mount 36 and the stiffness of the structure created by the helmet's presence just inside the device's left and right sidewall portions 40 & 44 enables easy manipulation of the mounting/fastening mechanism. In some embodiments, the key/remote mount 36 may be moved or added to the front exterior bottom portion 16, or the exterior of the glasses pocket 14, or the anchor assembly. The non-scratching key/remote retainer is intended to provide a soft contact point with the motorcycle, etc. so that the key ignition location does not become scratched while riding.

Figure 7:
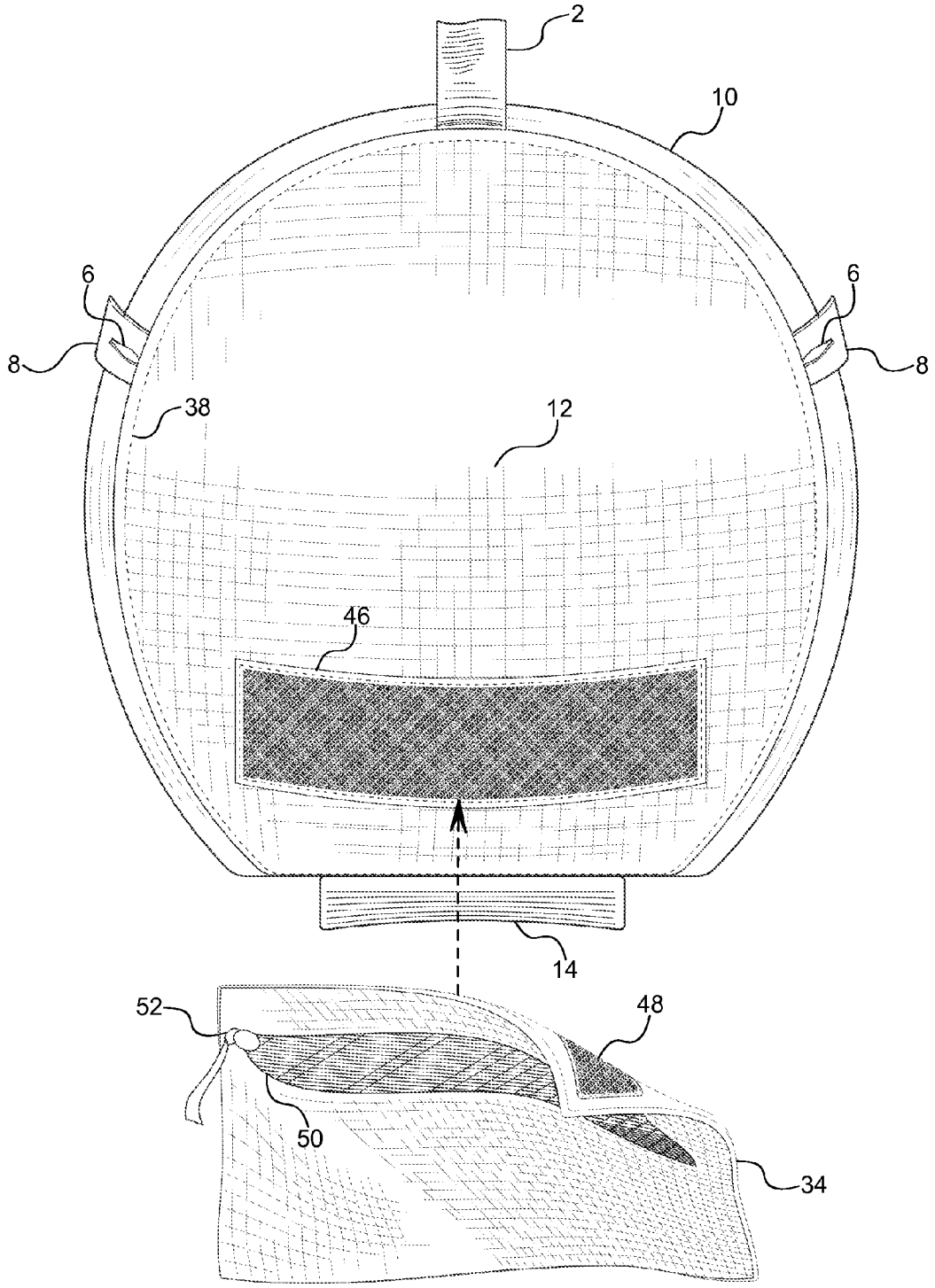
FIG. 7 is a rear view of the embodiment of FIG. 1 (including a removable pouch)
Figure 8:
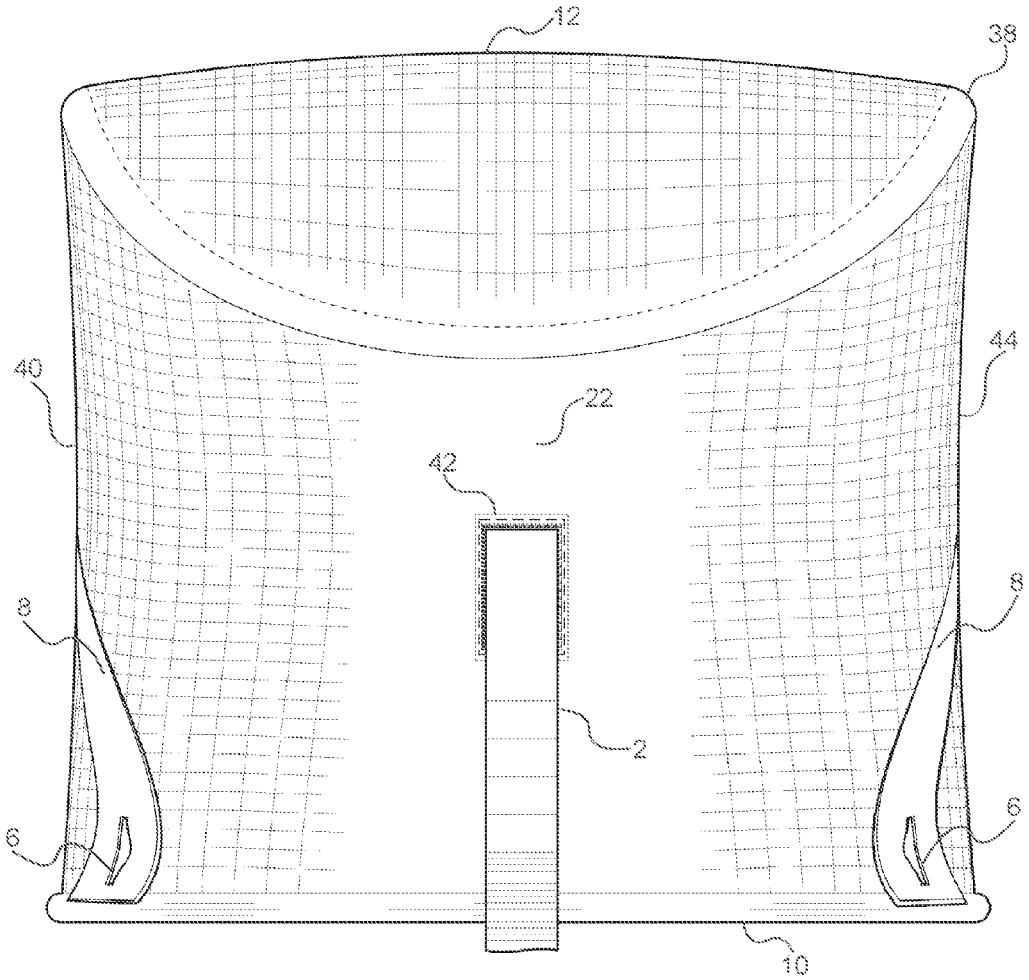
FIG. 8 is an angled top view of one embodiment.

On the exterior rear portion 12 of the device's main helmet compartment is the rear gloves & accessory compartment fastener 46 (FIG. 7). This is the mounting/fastening device for both; the hanging of a pair of off-season gloves (winter gloves during the summer and vice-versa), and the hanging of an accessory compartment 34 (FIGS. 5 & 7). Various embodiments of the mounting/fastening mechanism may be utilized, including; hook-and-loop fasteners, magnets, snaps, clips, buttons with buttonholes, elastic cords, hook-and-eye assemblies, or other suitable mounting/fastening mechanisms. The rear gloves and accessory compartment fastener 46 may be divided into two separate fasteners, one for off-season gloves and one for the accessory compartment 34. The relative location on the rear is designed to keep the rarely accessed items (helmet screws, chin curtain, breath deflector/guard, small tools, etc.) stored in the accessory compartment 34, and the unused off-season gloves, out of the way of the frequently used items. Attachment of the accessory compartment 34 is generally along the top portion so that the bottom and sides are separate of the device's rear portion 12. When the device is hung, the device's hanging angle allows gravity to pull the accessory compartment 34 away from the rear portion 12 of the device's main helmet compartment so that contact between the helmet and items stored in the accessory compartment 34 is minimized. The accessory compartment 34 may be detachable or in other embodiments permanently fixed to the device. When detachable, the accessory compartment fastener 48 (FIG. 7) can mate with the rear gloves & accessory compartment fastener 46. Generally, the accessory compartment interior 50 (FIG. 7) is the portion of the accessory compartment 34 that items are stored in. In some embodiments, the accessory compartment 34 can include an accessory compartment closure system 52 (FIG. 7) such as a zipper or an equivalent.

Figure 12:
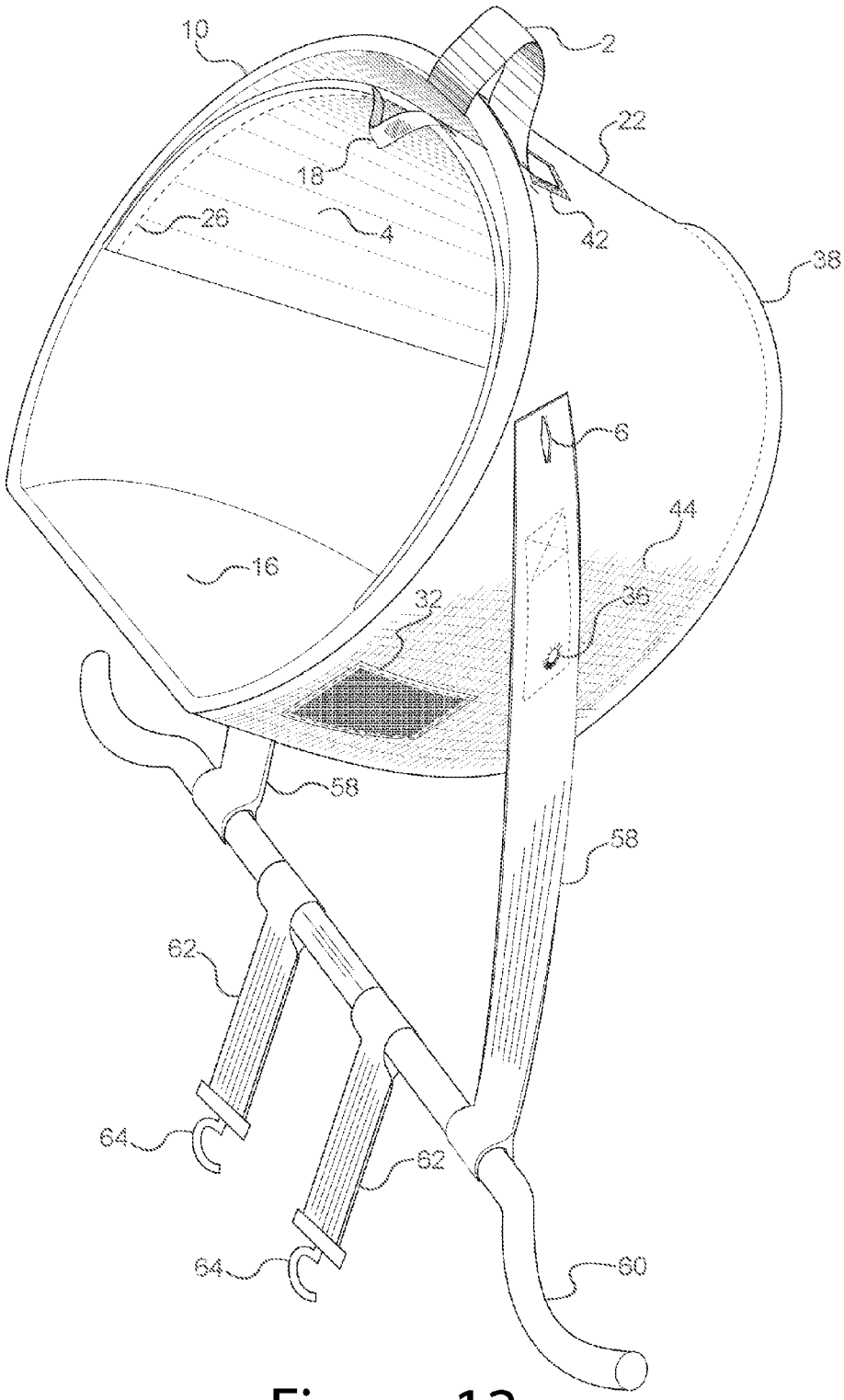
FIG. 12 is a perspective view of the front opening and right side of one embodiment.

A storage device may include the replacement of the left and right side anchor mounts 8, with left and right side anchor mounts that include equipment extensions 58 (FIG. 12). In an alternative embodiment, the left and right side anchor mounts 8 can remain, while the equipment extensions 58 can connect directly to the anchor button 72 on the anchor assembly. In both cases, the equipment extensions extend down below the bottom of the device and create a loop that accommodates an equipment bar hanger 60 (FIG. 12). The equipment bar hanger 60 is composed of plastic, metal, or an equivalent functioning material, and contains end portions designed to receive and support the neck opening of protective shoulder pads or a neck brace. Hanging from the equipment bar hanger 60, between or outside the anchor mounts with equipment extensions 58, are multiple equipment straps 62 (FIG. 12). The free end of the equipment straps 62 contains equipment hooks 64 (FIG. 12) designed to accommodate other protective gear. The hooks may be replaced by other fastener devices known in the field for being adept at holding protective equipment.

The front of the inside bottom portion 16 is viewable when the helmet is placed into the device. This area of the device may also be visible when the device is folded/collapsed for retail stocking/inventorying. As such, it can be an advantageous location for the placement of a logo, emblem, trade dress and/or other signage 54 (FIG. 11) that adds value to have a user read during use. Alternatively, a logo, emblem, trade dress and/or other signage may be placed on the device's hanging straps or on the front portion of the exterior left and right sidewall portions 40 & 44.

While aspects or features have primarily been described for motorized sports equipment, one skilled in the art would consider the use in the storage of athletic sports equipment and military equipment. A few examples include football, hockey, and lacrosse helmets, shoulder pads, elbow pads, shin guards, hip pads, thigh pads, knee pads, face shields, mouth guards, garter belts, athletic supporter & cup, etc.

I claim:

1. A helmet storage device comprising:

a compartment sized to receive a substantial portion of a helmet therein, the compartment defined by an arch shaped front opening having a send-rigid edge and generally conforming to a front view outline of the helmet, the compartment having an arched top portion, a bottom portion, first and second generally opposed flexible sidewall portions, and a semi-rigid arch shaped rear portion relatively matching the shape of the arch shaped front opening, wherein the arched top portion, bottom portion, and first and second sidewall portions extend between the arch shaped front opening and the arch shaped rear portion, and wherein the sidewall portions are arranged such that a downward force from the weight of the helmet received in the compartment of the device when suspended by an anchor assembly means, causes the sidewall portions to narrow about a part of the helmet.

2. The device of claim 1, wherein the bottom portion is foldable or collapsible, so that the devise as a whole may be collapsed while retaining the arch shaped front opening and the arched shaped rear portion in substantially original firms.

3. The device of claim 1, further comprising an angle adjuster or interlock proximate the top portion of the device to facilitate at least one of, enabling the adjustment of the angle at which the device may be suspended or permitting the vertical interlinking of multiple storage devices.

4. The device of claim 1, further comprising anchor mounts secured to top or sidewall portions, wherein the device is capable of being attached to the anchor assembly means.

5. The device of claim 4, further comprising one or more of a glove fastener, or an attachment mount for a key or remote retainer attached to an anchor mount or anchor assembly means.

6. The device of claim 1, wherein attachment locations for suspending the device, using the anchor assembly means, are positioned such that when the storage device is suspended at the attachment locations, the bottom portion of the compartment is oriented at an angle to retain the helmet therein by force of gravity by enabling the weight of the helmet to be spread over the bottom portion, the rear portion, or both the bottom and the rear portions of the device.

7. The device of claim 1, further comprising one or more glove fasteners accessible on an exterior of the storage device.

8. The device of claim 1, further comprising an attachment mount for a key or remote retainer on the exterior of the storage device.

9. The device of claim 1, further comprising a bar hanger attachable to the device with end portions for engaging equipment outside the anchor assembly means while substantially under the device.

10. The device of claim 9, wherein the bar hanger is attachable substantially in line with anchor assembly means.

11. The device of claim 9, further comprising multiple equipment straps attached to the bar hanger.

12. The device of claim 1, further comprising a passage in the bottom portion suitable to move air through the storage device.

13. The device of claim 12, further comprising a fan to motivate air through the passage.

14. A helmet storage device comprising:

a compartment sized to receive a substantial portion of a helmet therein, the compartment defined by an arch shaped front opening having a semi-rigid edge and generally conforming to a front view outline of the helmet, the compartment having an arched top portion, a bottom portion, first and second generally opposed sidewall portions, and a semi-rigid arch shaped rear portion relatively matching the shape of the arch shaped front opening, wherein the arched top portion, bottom portion, and first and second sidewall portions extend between the arch shaped front opening and the arch shaped rear portion, the compartment having a visor pocket located generally between the arch shaped front opening and the arch shaped rear portion and following the general contour extending between the arch shaped front opening and the arch shaped rear portion.

15. The device of claim 14, wherein attachment locations for suspending the device, using anchor assembly means, are positioned such that when the storage device is suspended at the attachment locations, the bottom portion of the compartment is oriented at an angle to retain the helmet therein by force of gravity by enabling the weight of the helmet to be spread over the bottom portion, the rear portion, or both the bottom and the rear portions of the device.

16. The device of claim 14, wherein the bottom portion of the compartment is contoured to a head opening of the helmet.

17. The device of claim 14, wherein a semi-rigid component of the bottom portion may separate from the sidewall and rear portions of the device and fold forward proximate the front opening bottom edge so that the device as a whole may be collapsed.

18. The device of claim 14, wherein the visor pocket bottom is biased by a semi-rigid material to motivate the pocket into an open position or into a closed position.

19. A helmet storage apparatus comprising:

a first device having a compartment sized to receive a substantial portion of a helmet therein, the compartment defined by an arch shaped front opening having a semi-rigid edge and generally conforming to a front view outline of the helmet, the compartment having an arched top portion, a bottom portion, first and second generally opposed sidewall portions, and a semi-rigid arch shaped rear portion relatively matching the shape of the arch shaped front opening, wherein the arched top portion, bottom portion, and first and second sidewall portions extend between the arch shaped front opening and the arch shaped rear portion, the compartment having an anchor mount means at the top or sidewall portions by which the first device is capable of being suspended and multi-device anchor assemblies attached to the anchor mount means of the first device, the multi-device anchor assemblies extending below the first device when suspended, and suited to attach to an anchor mount means of a second device, wherein the second device is functionally analogous to the first device.

20. The apparatus of claim 19, wherein the anchor mount means are anchor mounts secured to one or more of the devices and relatively oriented to align with the multi-device anchor assemblies.

21. The apparatus of claim 19, further comprising an angle adjuster or interlock proximate the top portion of the device to facilitate at least one of, enabling the adjustment of the angle at which the device may be suspended or permitting the vertical interlinking of multiple storage devices.

22. The apparatus of claim 19, further comprising a storage compartment attached to a multi-device anchor assembly means, an anchor mount means, or a compartment portion of the first or second devices, the storage compartment having a necked down portion to retain glasses or goggles.

23. A helmet storage device comprising:

a compartment sized to receive a substantial portion of a helmet therein, the compartment defined by an arch shaped front opening having a semi-rigid edge and generally conforming to a front view outline of the helmet, the compartment having an arched top portion, a bottom portion, first and second generally opposed sidewall portions, and a rear portion, wherein the arched top portion, bottom portion, and first and second sidewall portions extend between the arch shaped front opening and the rear portion, the compartment further comprising anchor mount means at the top or sidewall portions of the device suitable for suspending the device using anchor assembly means, such that the bottom portion of the compartment is oriented at an angle to retain the helmet therein by force of gravity by enabling the weight of the helmet to be spread over the bottom portion, the rear portion, or both the bottom and the rear portions of the device.

24. The device of claim 23, further comprising multi-device anchor assemblies attached to the anchor mount means of the first device, the multi-device anchor assemblies extending below the first device when suspended and suited to attach to anchor mount means of a second device, wherein the second device is functionally analogous to the first device.

* * * * *